United States Patent [19]

Maechtle et al.

[11] Patent Number: 4,938,631

[45] Date of Patent: Jul. 3, 1990

[54] FACADE ANCHOR

[75] Inventors: Daniel Maechtle, Korntal; Joachim Mayer, Stuttgart, both of Fed. Rep. of Germany

[73] Assignee: Maechtle GmbH, Fed. Rep. of Germany

[21] Appl. No.: 379,430

[22] Filed: Jul. 13, 1989

[30] Foreign Application Priority Data

Jul. 15, 1988 [DE] Fed. Rep. of Germany ..... 3824001
Nov. 28, 1988 [DE] Fed. Rep. of Germany ..... 3840055

[51] Int. Cl.[5] ..... E04B 1/00

[52] U.S. Cl. ..... 52/235; 52/7; 405/260

[58] Field of Search ..... 405/260, 259, 261; 52/235, 698, 704, 705, 701, 690

[56] References Cited

U.S. PATENT DOCUMENTS

| | | | |
|---|---|---|---|
| 2,347,581 | 4/1944 | Turner | 52/698 X |
| 2,633,735 | 4/1953 | Dondero | 52/698 X |
| 3,786,605 | 1/1974 | Winfrey | 52/235 |
| 4,028,857 | 6/1977 | Fischer | 52/704 |
| 4,096,672 | 6/1978 | Fischer et al. | 52/704 X |
| 4,631,889 | 12/1986 | Adam et al. | 52/704 X |
| 4,741,141 | 5/1988 | Harke | 52/704 X |
| 4,760,678 | 8/1988 | Chambers | 52/698 X |
| 4,773,794 | 9/1988 | Harke | 52/704 X |
| 4,776,143 | 10/1988 | Pointner | 405/260 X |

*Primary Examiner*—Dennis L. Taylor
*Attorney, Agent, or Firm*—Hodgson, Russ, Andrews, Woods & Goodyear

[57] ABSTRACT

A facade anchor for incorporation into mutually aligned bore holes of a main wall and a bracket-mounted facade, consisting of an anchoring element (22) which extends from the bore hole base to the front of the facade, a pipe which extends from the bore hole inlet to the footing wall for injecting mortar, with the pipe having outlet openings (28) for mortar which are arranged inside the facade bore hole, and also of lamellar seals surrounding the pipe (22) on the inlets and outlets of the bore holes of the footing wall and facade, and of a nonuniform surface of the anchoring element for improving the bond of the injected mortar.

7 Claims, 2 Drawing Sheets

FACADE ANCHOR

Figure 1:
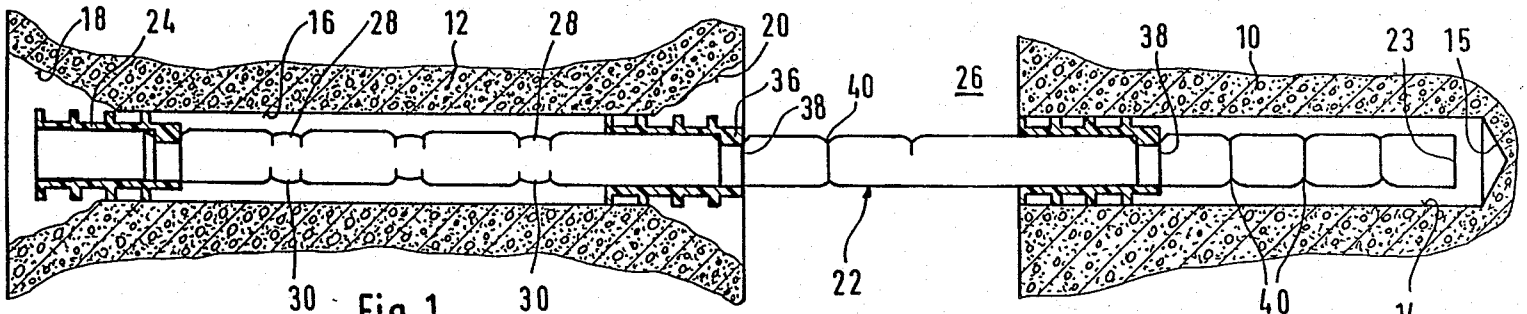

The invention relates to a facade anchor for incorporation into mutually aligned holes of a footing wall, and to a facade which is arranged, e.g. bracket-mounted, a distance in front of the facade anchor.

Known in the art is to connect the frost-resistant walls or facades arranged a distance in front of the actual main wall or footing wall with the main wall by means of bars bent in the shape of a Z, which are also called air space anchors. Such tie bars project from an opening of the main wall, for example, and their free end is mortared or concreted into a mortar joint or another receptacle of the bracket-mounted facade. Over time, the tie bars extending through the air space between the facade and main wall rust through, and then no longer satisfy the safety requirements, so that the facade can easily collapse during the course of the expansion changes caused by temperature differences. The object of the invention is to provide a facade anchor, preferably for reconstructing or renovating existing structures provided with bracket-mounted facades, which advantageously replaces the air space anchors used previously. In particular, the new facade is meant to achieve a guaranteed mortar filling of the bore hole in the footing wall, and also to ensure the possibility of using existing mortar joints in order to avoid additional anchoring bore holes and their seals in the wall to be reconstructed.

According to the basic idea of the invention, the object is achieved by an anchoring element which extends roughly from the bore hole base of the footing wall to the front side of the facade, in particular an anchoring element which may be inserted in a mortar joint, a pipe extending from the bore hole inlet through the facade and the air space up to the footing wall for injecting mortar, whose rear area located within the facade bore hole has outlet openings, through which the mortar bonds with the wall of the facade bore hole (16) and forms transverse webs which carry through the openings, the lamellar seals surrounding the pipe on the inlets and outlets of the bore holes of the footing wall and facade, and by a nonuniform surface of the anchoring element for improving the bond with the hardened mortar.

Therefore, such a proposed facade anchor for reconstructing or renovating existing facades encompasses an injection pipe which guarantees the complete filling of the wall bore holes in the footing and in the facade with mortar. This pipe has dimensions which may preferably be adjusted to the conventional mortar joint thickness of about 12 to 15 mm, and, under consideration of the lamellar seals provided for the external seal, has a diameter of about 8 mm, so that a distance of 2 to 3 mm is available all around given a favorable arrangement. The mortar bond between the pipe and the bore hole wall bordered in an axial direction by the lamellae comes about and is maintained in this space. In this way, the face-bricked or bracket-mounted facade of an existing structure may subsequently be reconstructed in a relatively fast and reliable manner and to last a long time.

In one embodiment of the facade anchor according to the invention, it is recommended that the anchoring element be designed as a corrosion-resistant pipe which essentially extends from the bore hole base of the footing wall to the front side of the facade and is undersized with respect to the bore hole diameter, which contains several diametric pairs of openings as the mortar outlet into the annular space formed with the bore hole wall. The advantage to this proposal is that the anchoring element simultaneously serves as a pipe for supplying the mortar, and has a high tensile and flexural strength, so that it may be designed with thin walls, and consequently provides sufficient space as the flow channel for the mortar to be injected, as well as for a surrounding annular jacket bond between the anchoring element and bore hole wall.

In another embodiment of the facade anchor according to the invention, the anchoring element consists of a wire nail with at least one head-shaped expansion arranged near the bore hole base of the footing wall, and is surrounded at a distance by the injection pipe, which extends into the footing wall. The external circumference of this pipe carries groups of sealing lamellae, between which there is a distance roughly corresponding to the width of the ventilating gap as well as a somewhat smaller distance than the facade thickness.

The second embodiment described above is particularly suited for use during the reconstruction of older facades which have not yet been provided with expansion-limiting arrangements in accordance with more recent building regulations. In the case of greater overall heights, relative shifts of up to 8 mm may arise due to unfavorably large differences in the heat expansion coefficients, for example between a footing wall consisting of concrete and a brickwork facade. If a several mm thick steel wire is used as the anchoring element under these conditions, it will have both the necessary stability and elasticity for power transmission with consideration of the arising transverse movements and relative shifts between the carrying footing and facade. Such relative shifts generally disrupt the mortar column in the annular gap between the bore hole wall and the anchoring element, since it exhibits far less elasticity than the anchoring element. However, since the annular gap has a relatively low wall thickness in the area of the air gap and on both sides of the air gap according to the invention, the disruption of the mortar column remains limited, while the mortar bond is retained in the depth of the bore holes of the footing wall and the facade wall, as a result of which the necessary power transmission for anchoring the facade is not impaired.

Figure 4:
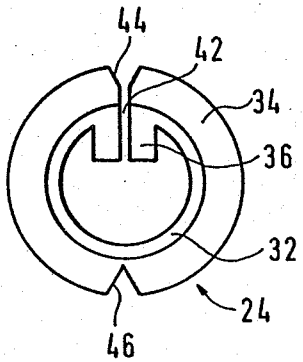
Figure 2:
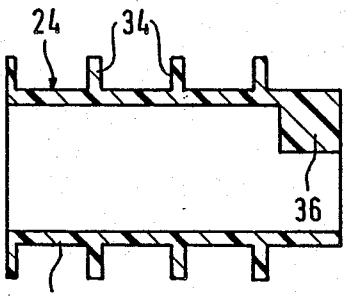
Figure 3:
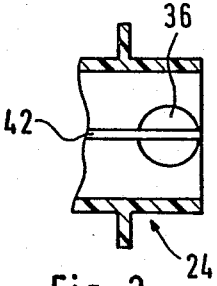
Figure 5:
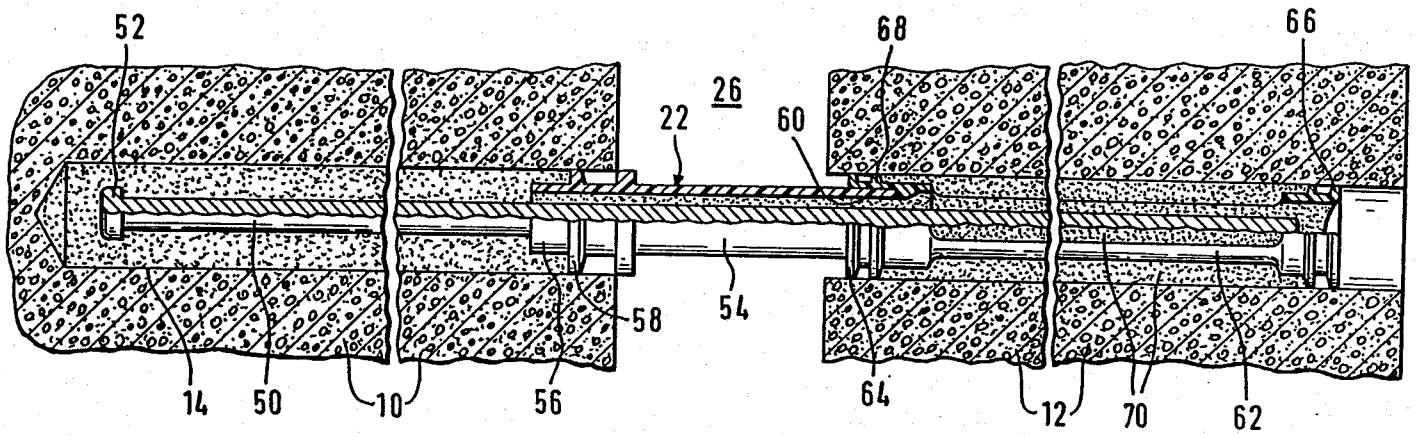

Additional features and advantages of the invention are outlined in the following description of an embodiment based on the drawing, which shows details important in terms of the invention, as well as in claims. Shown on FIG. 1 is a diagrammatic longitudinal section through a facade anchor according to an embodiment of the invention in a built-in state in bore holes of a main wall and a frost-resistant wall, FIG. 2 is an enlarged longitudinal section through a lamella bush as a seal for the annular space between the anchor pipe and bore hole wall, FIG. 3 is a partial section of the lamella bush turned by 90° relative to FIG. 2, FIG. 4 is an end view of the lamella bush according to FIG. 2, and on FIG. 5 is a diagrammatic longitudinal section through a facade anchor according to a second embodiment of the invention in a built-in state.

Ventilating or insulating gap 26 is arranged between a main or footing wall 10 and a bracket-mounted facade 12, which are shown diagrammatically in FIG. 1 in a vertical section. This gap is normally used for back-ventilating the facade and, if necessary, can be filled with insulating material. A bore hole 16 aligned with a bore hole section 14 in the footing wall 10 extends through the facade 12. While the bore hole preferably corresponds roughly to the thickness of a conventional mortar joint of 12 to 15 mm, other dimensions are also possible. In the case of larger dimensions, when mortar joints or areas beside them must be bored open, the broken out wall regions 18 and 20 shown on FIG. 1 can come about at the inlet and outlet of the facade bore hole.

An anchor pipe 22 preferably made out of thin-walled special steel is introduced into the prepared bore holes 14, 16. The preceding end 23 of this pipe extends to the vicinity of the bore hole base 15. As the facade anchor, the anchor pipe 22 carries a total of three lamella bushes 24 consisting of a flexible material or plastic, which serve as concentric sealing stoppers for the mortar compound to be filled in. Each lamella bush 24 consists of a jacket 32 which abuts the outside of the anchor pipe, and from which annular lamellae 34 pointing in a radial direction extend. The lamellae 34, which may also be helically molded on the jacket if necessary, are supported against the wall of bore holes 14 and 16, and are then active as a seal with respect to the mortar compound injected through the anchor pipe.

An inwardly directed projection or knob 36 is preferably molded on the internal side of the lamella bush at the preceding end which extends in the direction of the bore hole. This projection or knob may have a circular circumference in the enlarged depiction according to FIG. 3. A positioning opening 38 is assigned to each knob in the anchor pipe. The knob 36 is pressed into this opening, as a result of which the lamella bush is positioned in an axial direction. The position of these openings 38 in the anchor pipe may be adjusted to the conditions given by the respective wall.

As is evident from FIG. 1, a lamella bush 24 seals the annular space around the anchor pipe into the footing wall at the inlet of the bore hole 14. The following lamella bush 24 is located on the back side of the facade wall 12, i.e. on the internal side of the ventilating gap 26, where it seals the annular space existing around the anchor within the facade wall from the back. On the other hand, the annular space is sealed from the front by the lamella bush arranged at the bore hole inlet to the facade wall. The length of the lamella bushes 24 is such that areas of the wall broken out around the inlet and outlet are still taken into account, and that two lamellae still abut the undamaged bore hole wall in each case.

The anchor pipe 22 is open at both ends. According to FIG. 1, the anchor pipe 22 can be made flexible at various locations, preferably in the area of the ventilating gap, by means of transverse beads or notches 40, which are preferably arranged in pairs on opposing sides, and are additionally offset by 90° to each other in pairs. In order to achieve a particularly effective bond between the facade wall, mortar compound and anchor, the circumference of the anchor pipe 22 may be roughened or corrugated, whether entirely or only in the facade area.

In addition, several pairs of opposing openings 28, 30 are located in the anchor pipe in the area of the facade, through which the mortar exits into the annular space between the anchor pipe and bore hole wall, after the bore hole 14 in the footing wall has been filled and a pressure has built up. After the mortar has hardened, transverse webs or rupture webs extending through the anchor pipe 22 come about, which are connected with the filling compound in the annular space and are used to impart the retention.

According to FIGS. 3 and 4, the lamella bush 24 is provided with a longitudinal slit 42. A V-shaped recess 46 is advisedly arranged in the lamellae 34 on the side opposite the longitudinal slit, in order to facilitate the swivelling of the lamella bush. Additional V-shaped recesses 44 may be provided in addition in order to ease the exit of air from the bore hole if the filling compound is injected.

According to FIG. 5, a hammer drill is used to make a bore hole 16 in the mortar joint between two bricks of a facade wall 12 in need of reconstruction and a pocket hole 14 in the footing located in back. After the bore holes have been cleansed of bore dust and moistened, an injection pipe preferably consisting of plastic parts is assembled and introduced into the aligned bore holes. The injection pipe encompasses a plastic pipe 54 for bridging the ventilating gap 26 and a reversed plastic sleeve 62, which are inserted into each other and introduced into the bore hole until they have been pressed a defined distance into the facade bore hole 16.

The preceding end 56 of plastic pipe 54 has external sealing lamellae 58 which prevent the mortar from exiting the wall bore hole 14. The plastic pipe is elongated beyond the penetrating depth of the sealing lamellae, so that a mold network can be clamped on with a plastic ring, as in the case of the steel pipe described above. This ring ensures operation even in the case of hollow chamber bricks, ventilated bricks or honeycomb bricks. The overall length of the plastic tube 54 depends on the ventilating gap 26, measuring the length of the ventilating gap and extending a specific distance into the bore hole 14 in the footing wall or into the bore hole 16 of the facade wall.

The back end 60 of the plastic tube 54 is placed in a receptacle 68 surrounded by external sealing lamellae 64 at the preceding face of the plastic sleeve 62 introduced into the facade bore hole. The sealing lamellae 64 border the mortar-filled hollow space surrounded on the outside by the bore hole wall in the facade wall in the direction to the ventilating gap 26. Sealing lamellae 66 are located at the external periphery near the inlet of the bore hole 16 at the rear end of the plastic sleeve 62, and the plastic sleeve 62 contains several longitudinal slits 70 in the area between the preceding lamellae 64 and the rear lamellae 66, through which the mortar exits into the external annular space at the latest after the bore hole 14 in the footing wall has been completely filled and an elevated pressure has built up.

The plastic tube 54 is preferably inserted with a press fit into the receptacle 68 of the plastic sleeve 62, and is there arrested by a stop shoulder. The plastic sleeve 62 can have a total of four longitudinal slits 70. Following the injection of mortar, an anchoring element in the form of a wire-wound armature 50 is inserted into the the injection pipe. This anchoring element can have at least one widened nail head 52 at the preceding end. If the dimensions permit unobstructed mortar injection, the wire-wound armature 50 can also be introduced into the wall bore holes together with the plastic injection pipe. For example, the mortar is pressed into the bore hole with a funnel, during which it penetrates through the annular gap between the wire-wound armature and injection pipe into the bore holes, and fills the bore holes. The material seal between the mortar and carrying footing gives rise to a substantial material bond for the anchorage. This bond is expanded by the penetrating mortar during the application of a mold network, so that an adhesion-actuated bond comes about due to the back-shaping of the bore hole. The annular shape between the wire-wound armature and the internal wall of the plastic tube is preferably small.

We claim:

1. A facade anchor for anchoring a facade to a main wall, the facade being arranged at a distance in front of the main wall and the facade and main wall having aligned bores; the facade anchor comprising:

an elongate connecting element in the form of a thin-walled and corrosion-resistant metallic anchoring tube for insertion into aligned bores of the main wall and the facade, the tube forming a mortar injection pipe, the front end of which is open to act as an outlet opening, said tube having a number of diametrically disposed outlet openings along its rear portion and leading into the facade bore through which mortar may be discharged to form transverse webs extending from the wall of the facade bore through said diametral openings, the anchoring tube being reinforced at several places along its length by diametrically arranged pairs of transverse identations which run parallel to the circumference to improve the tensile and flexural strength so that the anchoring tube has a limited resiliency allowing relative movements of the facade with respect to the main wall; and plastic material bushings for centrally positioning the anchoring tube within said bores, each of the bushings having radially outwardly extending resilient annular lamellae for sealing the tube within the bores.

2. The facade anchor according to claim 1, characterized by the fact that the transverse indentations of the tube are offset by 90° to each other in pairs in the same radial plane and in an axial sequence.

3. The facade anchor according to claim 2, characterized by the fact that the external circumference of the tube is provided with grooves similarly to a screw thread.

4. The facade anchor according to claim 2, characterized by the fact that the external circumference of the tube is roughened.

5. The facade anchor according to claim 1 wherein each of the bushings includes a jacket directly enveloping the tube, there being at least one radially directed knob molded on the internal side of the jacket, the knob being received in an opening of the tube for axially fixing the bushing.

6. The facade anchor according to claim 5, characterized by the fact that each of the bushings is longitudinally slit for simplified assembly, and that the longitudinal slit extends through the molded on knob.

7. The facade anchor according to claim 6, characterized by the fact that the lamellae of each bushing contains a V-shaped recess at least on the side opposite the longitudinal slit, which facilitates the swivelling of the bushing and ventilation during the injection of mortar.

* * * * *